US009194216B2

(12) United States Patent
Lucas et al.

(10) Patent No.: US 9,194,216 B2
(45) Date of Patent: Nov. 24, 2015

(54) MANIPULATABLE FILTER SYSTEM

(71) Applicant: Halliburton Energy Services, Inc., Houston, TX (US)

(72) Inventors: Bryan Chapman Lucas, Duncan, OK (US); Wesley John Warren, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 296 days.

(21) Appl. No.: 13/872,891

(22) Filed: Apr. 29, 2013

(65) Prior Publication Data

US 2014/0318810 A1 Oct. 30, 2014

(51) Int. Cl.

| | |
|---|---|
| ***B01D 29/52*** | (2006.01) |
| ***E21B 43/02*** | (2006.01) |
| ***E21B 21/06*** | (2006.01) |

(52) U.S. Cl.

CPC ..... *E21B 43/02* (2013.01); *E21B 21/062* (2013.01)

(58) Field of Classification Search

CPC ..... E21B 21/06; E21B 21/063; E21B 21/065; B01D 29/0009; B01D 29/014; B01D 29/035; B01D 29/52; B01D 29/606; B01D 29/66; B01D 29/668; B01D 35/12; B03B 9/00; B03B 5/00

See application file for complete search history.

(56) References Cited

U.S. PATENT DOCUMENTS

| | | | | |
|---|---|---|---|---|
| 5,655,852 | A * | 8/1997 | Duffney et al. | 405/128.2 |
| 2011/0030951 | A1 * | 2/2011 | Irvine et al. | 166/278 |

* cited by examiner

*Primary Examiner* — Catherine Loikith

(74) *Attorney, Agent, or Firm* — John W. Wustenberg; Baker Botts L.L.P.

(57) ABSTRACT

A manipulatable filtering system for use in a wellbore servicing system is disclosed. The system includes a first wellbore servicing system component configured to communicate a fluid via a first fluid conduit and a second wellbore servicing system component comprising a second fluid conduit. A filter system having an input conduit is in fluid communication with the first fluid conduit. The filtering system includes a plurality of input flow paths, each in fluid communication with the input conduit. The system further includes a plurality of filter housings, each in fluid communication with one of the plurality of input flow paths. A filter is disposed within each of the filter housings. A plurality of output flow paths are in fluid communication with the filter housings and an output conduit is in fluid communication with each of the output flow paths and the second fluid conduit.

19 Claims, 4 Drawing Sheets

MANIPULATABLE FILTER SYSTEM

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Various types of wellbore fluids are used in operations related to the drilling, completion, and production of hydrocarbon reservoirs. Examples of such operations include drilling a wellbore to penetrate a subterranean formation, fracturing a subterranean formation, perforating a subterranean formation, acidizing of a subterranean formation, or otherwise modifying the permeability of a subterranean formation. Other examples of such operations include placing of a chemical plug to isolate zones or complement an isolating operation. The fluids employed in one or more of such operations include drilling fluids, completion fluids, work over fluids, packer fluids, fracturing fluids, conformance or permeability control fluids, the like, and combinations thereof. One or more of the fluids may comprise (e.g., be formed by mixing) two or more fluid components, for example, a dry bulk material (e.g., a powder), a liquid, and/or one or more additives. Transporting, conveying, storing, or otherwise providing such components (e.g., a dry bulk, a liquid, an additive, etc.) to wellbore servicing equipment (e.g., a mixer) may lead to the introduction of trash or debris into the mixture. The presence of trash or debris within such a mixture can lead to decreased system performance (e.g., via a fluid flow reduction or restriction) and/or damage to one or more wellbore servicing tools (e.g., a mixer). As such, devices, systems, and methods for detecting and/or removing trash and debris from a wellbore servicing fluid and/or the components thereof are needed.

SUMMARY

Disclosed herein is a wellbore servicing system comprising a first wellbore servicing system component configured to communicate a fluid via a first fluid conduit, a second wellbore servicing system component comprising a second fluid conduit, and a filter system comprising an input conduit in fluid communication with the first fluid conduit, a plurality of input flow paths, wherein each input flow path is in fluid communication with the input conduit, a plurality of filter housings, wherein each filter housing is in fluid communication with one of the plurality of input flow paths, a filter disposed within each of the filter housings, a plurality of output flow paths, wherein each output flow path is in fluid communication with one of the filter housings, an output conduit in fluid communication with each of the output flow paths and the second fluid conduit.

Also disclosed herein is a wellbore servicing method comprising providing a first wellbore servicing system component, providing a second wellbore servicing system component, providing a filter system comprising an input conduit, an output conduit, and a plurality of fluid flow paths between the input conduit and the output conduit, wherein, each flow path comprises a filter, connecting the filtering system to the first wellbore servicing system component via a first fluid conduit, connecting the filtering system to the second wellbore servicing system component via a second fluid conduit; and communicating a fluid from the first wellbore servicing system component to the second wellbore servicing system component via the filtering system.

Further disclosed herein is a wellbore servicing tool comprising an input conduit in fluid communication with a first fluid conduit, a plurality of input flow paths, wherein each input flow path is in fluid communication with the input conduit, a plurality of filter housings, wherein each filter housing is in fluid communication with one of the plurality of input flow paths, a filter disposed within each of the filter housings, a plurality of output flow paths, wherein each output flow path is in fluid communication with one of the filter housings, an output conduit in fluid communication with each of the output flow paths and the second fluid conduit.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
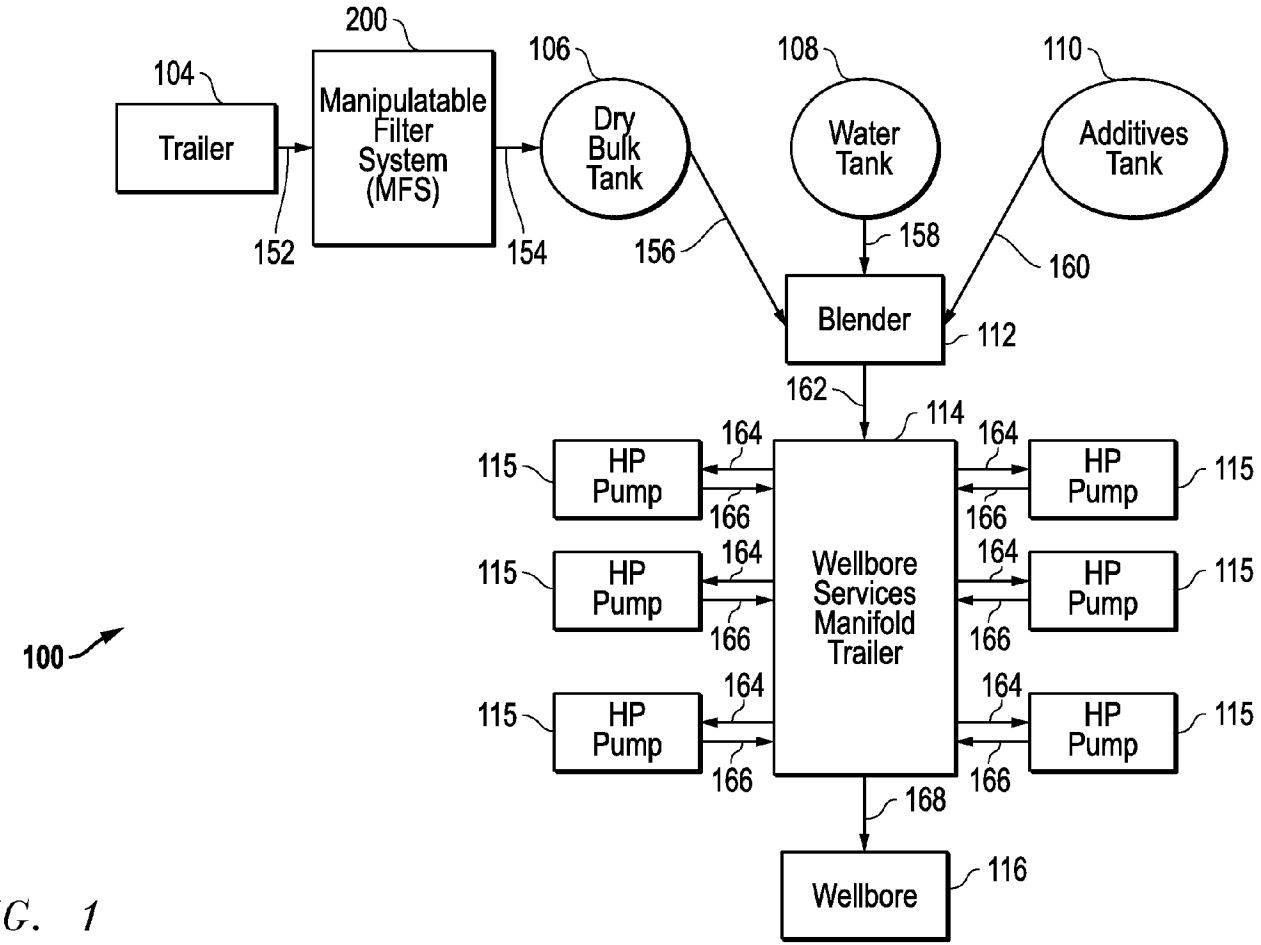
FIG. 1 is a schematic diagram of an embodiment of an operating environment of a pneumatic filtering system.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream,"

or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of a manipulatable filtering system (MFS), a wellbore servicing system comprising a MFS, and a method of using the same. In an embodiment, a MFS may be employed to capture or collect trash or debris from a material line (e.g., a fluid fill line, a bulk material conveyance line, etc.), for example, during the transport and/or conveyance of a fluid or other bulk material therethrough, for example, to one or more wellbore servicing tools. For example, the MFS may be used to capture debris from a material line and to allow an operator to remove the debris from the fluid or material transported therethrough, for example, thereby maintaining the wellbore servicing system performance and reliability. In one or more of the embodiments disclosed here, the MFS may be disclosed with reference to a "fluid" being communicated therethrough. As used herein, "fluid" should not be construed as necessarily limited to a liquid or gaseous material, but may also include any material suitably communicated through a flowline (e.g., liquids, as well as dry bulk materials, such as powders).

Referring to FIG. 1, an embodiment of an operating environment of a wellbore servicing system 100 comprising a MFS 200 is illustrated. In an embodiment, the operating environment generally comprises a well site associated with a wellbore 116. In the embodiment of FIG. 1, the wellbore servicing system 100 generally comprises a trailer 104, the MFS 200, a plurality of storage tanks, a blender 112, a wellbore services manifold trailer 114, a plurality of pumps 115, and the wellbore 116. In an embodiment, as will be disclosed herein, two or more components of the wellbore servicing system may be fluidicly coupled via one or more flowlines.

It is noted that the term "flowline" may generally refer to a generally tubular structure with an axial flowbore, for example, a tubing, a hosing, a piping, a conduit, a fluid line, or any other suitable structure for communicating a fluid, gas, or other bulk material as would be appreciated by one of ordinary skill upon viewing this disclosure. Additionally, flowlines may be coupled or connected together, for example, via flanges, collars, welds, pipe tees, elbows, internally and/or externally threaded connections, etc.

In an embodiment, the trailer 104 may generally comprise a truck and/or trailer comprising one or more tanks, vessels, or manifolds for receiving, organizing, and/or distributing a fluid (e.g., water, gel, powdered gel, a gelling agent, cementitious fluid or cementitious slurry, etc.) to a wellbore site and/or during wellbore servicing operations. Additionally, the trailer 104 may be configured to load/unload the fluid via the operation of a pump (e.g., a fluid pump), via the movement of forced air (e.g., generated via a pneumatic pump or a blower, etc.), via movement by gravity, or any other suitable method of conveyance. For example, in an embodiment the trailer 104 may be configured to pneumatically pump a fluid or bulk material (e.g., a powder) from the trailer 104 to the MFS 200, for example, via flowline 152. While the embodiment of FIG. 1 illustrates an embodiment in which a fluid or bulk material contained in a trailer tank is communicated through the MFS 200, one of ordinary skill in the art upon viewing this disclosure will appreciate that a fluid may be communicated through a similar MFS from any suitable vessel or container and, as such, this specification should not be construed as so-limited.

In an embodiment, the MFS 200 may be generally configured to capture or collect trash or debris from a fluid or a bulk material moving between a plurality of wellbore servicing tools (e.g., from a fluid or bulk material moving via flowline during the transport and/or conveyance of the fluid or bulk material there-through, for example, during wellbore servicing operations and/or in preparation for a wellbore servicing operation). For example, the MFS 200 may be configured to capture or collect trash or debris during transport/conveyance of the fluid/bulk material from the trailer 104 to one or more storage tanks via a flowline (e.g., flowline 152). In an embodiment, the MFS 200 may allow an operator to remove the debris prior to the debris entering the storage tank (e.g., to the dry bulk tank 106 via flowline 154). In an alternative embodiment, the MFS 200 may be in fluid communication (e.g., incorporated within) with any flowline of the wellbore servicing system 100 to capture debris from any plurality of wellbore servicing tools of the wellbore servicing system 100.

Figure 2:
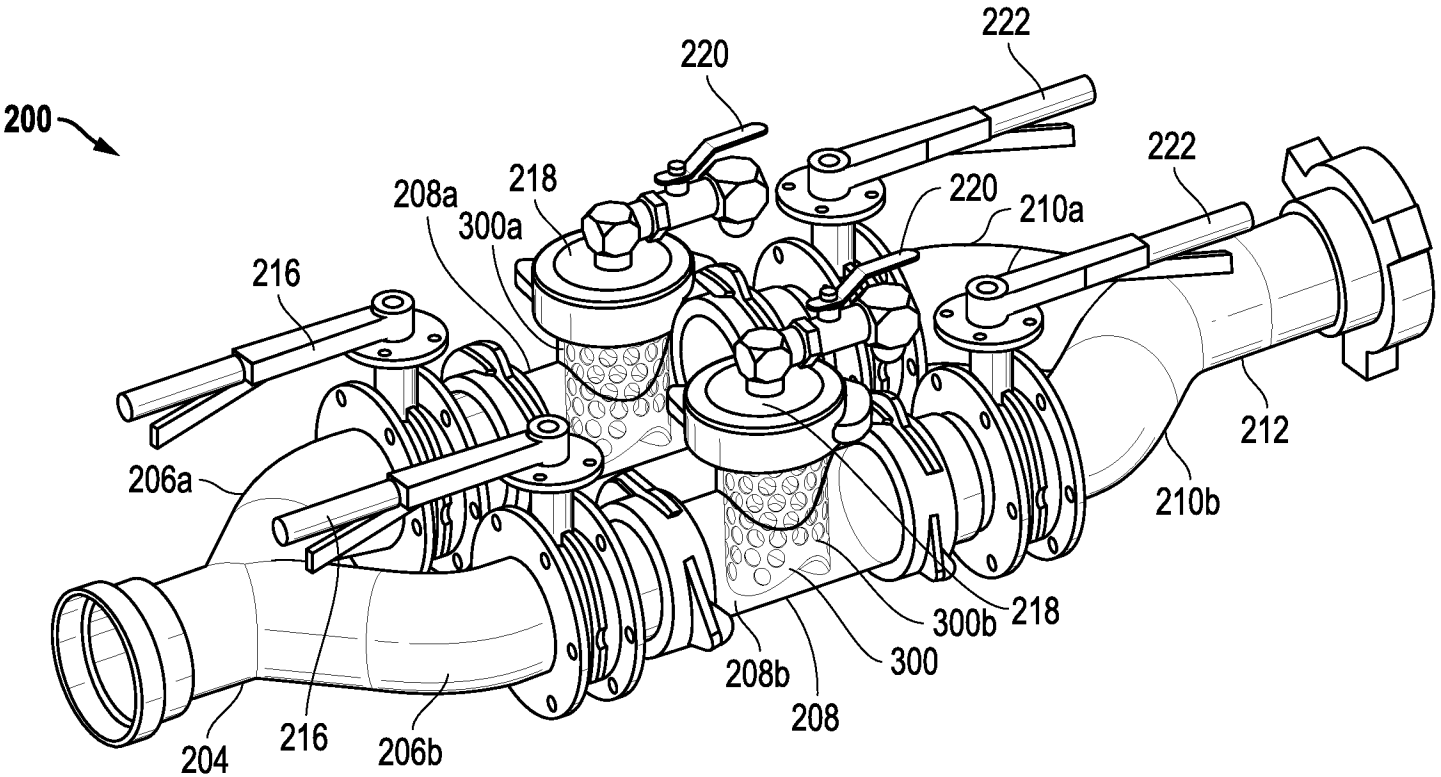
FIG. 2 is a perspective view of an embodiment of a pneumatic filtering system.

Referring to FIG. 2, an embodiment of the MFS 200 is illustrated comprising two, generally parallel, flow paths, as will be disclosed herein. In such an embodiment, the MFS 200 may generally comprise an input conduit 204 in fluid communication with a plurality of input flow paths (e.g., a first input flow path 206*a*, a second input flow path 206*b*, etc.). For example, in the embodiment of FIG. 2, the input conduit 204 forms a "Y" or manifold-like member generally configured to supply fluid to each of the first input flow path 206*a* and the second input flow path 206*b*. Additionally, each of the input flow paths may be in fluid communication with a filter housing 208 (e.g., a first filter housing 208*a*, a second filter housing 208*b*, etc., respectively). Each of the filter housings 208 may be in fluid communication with an output flow path (e.g., a first output flow path 210*a*, a second output flow path 210*b*, etc.). Further, each of the output flow paths may be in fluid communication with an output conduit 212 which forms a "Y" or manifold-like member. In an alternative embodiment, the MFS 200 may comprise any suitable number of flow paths, for example, one, three, four, five, six, seven, eight, nine, etc.

In an embodiment, the MFS 200 may be formed of a unitary structure; alternatively, the MFS 200 may be formed of a plurality of discrete components joined together via a suitable interface (e.g., a clamp, a threaded connection, a flanged connection having a plurality of bolts, a welded connection, etc.).

In an embodiment, input flow paths (e.g., the first input flow path 206*a*, the second input flow path 206*b*, etc.) may be configured to allow or disallow fluid communication between the input flow path and the filter housing thereof, for example, via an input side isolation valve 216 (e.g., a butterfly valve, a ball valve, etc.). For example, the input side isolation valve 216 may each be selectively configurable between a first position which allows fluid to be communicated via the input flow path and the filter housing and a second position which does not allow fluid to be communicated via the input flow path and the filter housing. Additionally, the output flow paths (e.g., the first output flow path 210*a*, the second output flow path 210*b*, etc.) may be configured to allow or disallow fluid communication between the filter housing thereof and the output conduit 212, for example, via an output side isolation valve 222 (e.g., a butterfly valve, a ball valve, etc.). For example, the output side isolation valves 222 may each be selectively configurable between a first (e.g., open) position which allows fluid to be communicated via the output flow path and the filter housing and a second (e.g., closed) position which does not allow fluid to be communicated via the output flow path and the filter housing. As such, one or more flow paths may be configured in an inactive configuration (e.g., the input side isolation valve and the output side isolation valve associated with that flow path are in the second, closed position), thereby substantially restricting and/or prohibiting fluid communication via the flow path and/or the filter housing. Alternatively, one or more flow paths may be configured in an active configuration (e.g., the input side isolation valve and the output side isolation valve associated with that flow path are in the first, open position), thereby allowing fluid communication via the flow path and/or the filter housing.

Figure 3:
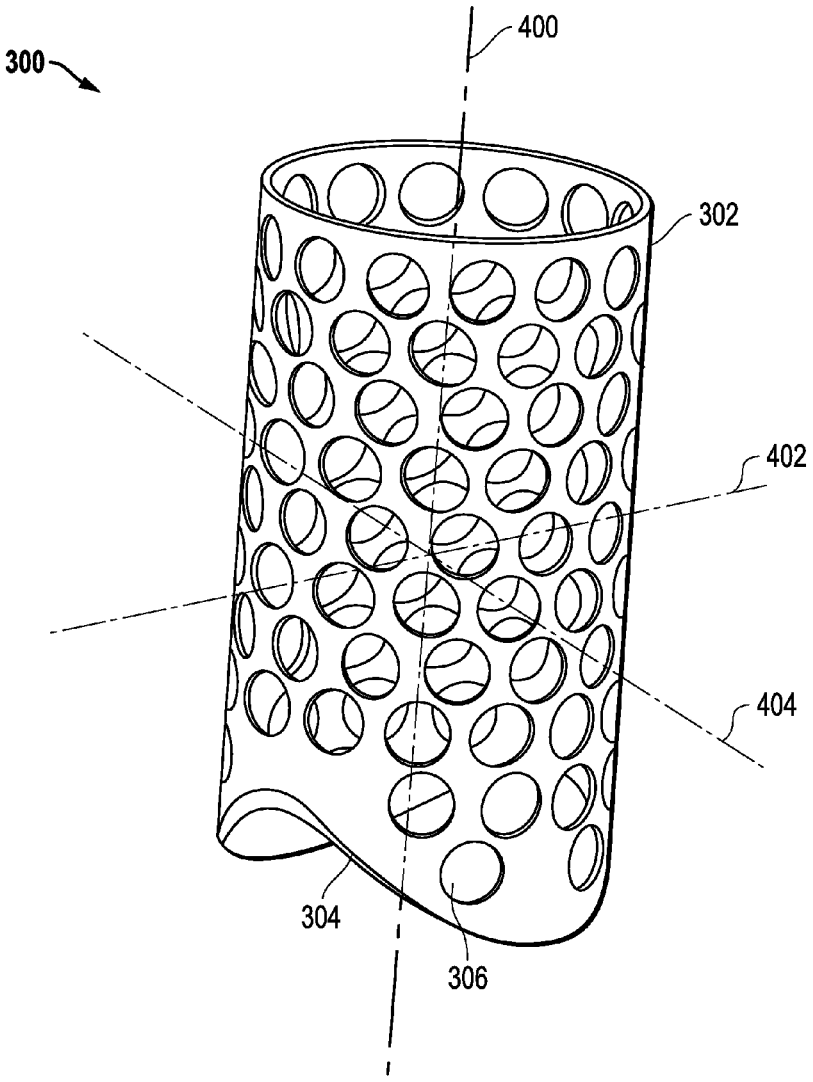
FIG. 3 is a perspective view of an embodiment of a filter.

In an embodiment, the filter housing 208 may be configured to house a filter or strainer 300 (e.g., a first filter 300*a*, a second filter 300*b*, etc.). For example, referring to FIG. 3, in an embodiment, the filter 300 may generally comprise a substantially hollow cylindrical body 302 having a longitudinal axis 400 and comprising a plurality of perforations or holes 306 disposed radially about, along, and/or through the cylindrical body 302. In an embodiment, the holes 306 may be sized to allow a fluid to be communicated through the filter 300 via the holes 306 and to disallow trash or debris to be communicated through the filter 300 via the holes 306. For example, in an embodiment, the diameter of the holes 306 may be about 1 inch, alternatively, about 0.75 inches, alternatively, about 0.5 inches, alternatively, about 0.25 inches, alternatively, any suitable diameter as would be appreciated by one of ordinary skill in the art upon viewing this disclosure. Additionally, the filter 300 may further comprise a "saddle" or curved profile 304 along one or both terminal portions of the cylindrical body 302. In such an embodiment, the "saddle" profile may define a first rotational orientation along a first radial axis 402 and a second rotational orientation along a second radial axis 404 (e.g., an axis rotated about 90 degrees about the longitudinal axis 400 from the first radial axis 402). For example, the "saddle" profile may be formed such that the filter 300 may engage with and/or seat within the filter housing 208 (e.g., against an inner curvature of the filter housing 208) in the first rotational orientation and not in the second rotational orientation with respect to the longitudinal axis 400; alternatively, in the second rotational orientation and not the first rotational orientation. In an alternative embodiment, the filters may take any suitable configuration. For example, the filters may comprise a rectangular cross-section, the filters may be substantially flat, etc.

Referring again to FIG. 2, the filter 300 (e.g., the first filter 300*a*, the second filter 300*b*, etc.) may be removably positioned within the filter housing 208 (e.g., the first filter housing 208*a*, the second filter housing 208*b*, etc.) such that a fluid may be communicated between the input flow paths (e.g., the first input flow path 206*a*, the second input flow path 206*b*, etc.) and the output flow paths (e.g., the first output flow path 210*a*, the second output flow path 210*b*, etc.) via the filter (e.g., via the filter holes 306). In an additional embodiment, the MFS 200 may comprise a plurality of filters 300 inline (e.g., two filters in series or in-line) with each other. In an embodiment, the filters may be different (e.g., comprising different size holes 306, for example, subsequently smaller holes 306) or they may be similar (e.g., comprising similar hole sizes, for example, for redundancy). The filter 300 may be retained within filter housing 208, for example, via a housing lid 218. In such an embodiment, the housing lid 218 may be coupled or joined with the filter housing 208, for example, via a threaded connection, a Victaulic connection, a clamp, or any other suitable method as would be appreciated by one of ordinary skill in the art upon viewing this disclosure. In an additional or alternative embodiment, the filter 300 may be joined and/or incorporated with the housing lid 218. Additionally, the filter housing 208 and/or the housing lid 218 may further comprise a relief valve 220 (e.g., a pressure relief valve, a ball valve, etc.) and may be configured to release a pressure contained within the filter housing 208, for example, prior to removing a filter 300, as will be disclosed herein. In an additional or alternative embodiment, the filter housing 208 may further comprise bleeder valve or a drain plug. For example, the filter housing 208 may be configured to drain a fluid trapped within the filter housing 208 via the drain plug (e.g., when the filter housing 208 is fluidicly isolated, for example, via the operation of the input side isolation valves 216 and the output side isolation valve 222).

Referring to FIG. 1, in an embodiment, the wellbore servicing system 100 may comprise a plurality of storage tanks, for example, a dry bulk tank 106, a water tank 108, and/or an additives tank 110. For example, the dry bulk tank 106 may comprise and/or store a fluid or bulk material (e.g., a gel, a powdered gel, a gelling agent, cementitious fluid or cementitious slurry, etc.) communicated (e.g., pneumatically) from the trailer 104 via the MFS 200. Additionally, one or more of the storage tanks (e.g., the dry bulk tank 106, the water tank 108, and/or the additives tank 110) may be configured to feed into the blender 112 (e.g., via flowline 156, flowline 158, and flowline 160, respectively). In an embodiment, the dry bulk tank 106 may store a sand, a proppant, a powder, a powdered gel, or the like. Additionally, the water tank 108 may store potable, non-potable, untreated, partially treated, or treated water. In an embodiment, the water may be produced water that has been extracted from a wellbore while producing hydrocarbons from the wellbore. In an embodiment, the water may be flowback water that has previously been introduced into the wellbore during wellbore servicing operations. The water may further comprise local surface water contained in natural and/or manmade water features (e.g., ditches, ponds, rivers, lakes, oceans, etc.). Additionally, the water may comprise water stored in local or remote containers. The water may be water originated from near the wellbore and/or may be water that has been transported to an area near the wellbore from any distance. In an embodiment, the water may comprise any combination of produced water, flowback water, local surface water, and/or container stored water. Additionally or alternatively, one or more of the storage tanks store oleaginous fluid, concentrates, premixed fluids, or any other fluid as would be appreciated by one of ordinary skill in the art upon viewing this disclosure.

In an embodiment, a blender 112 (e.g., an advanced dry polymer blender, a gel pro blender, etc.) may be configured to mix solids (e.g., dry bulk, a powder, etc.) and fluids (e.g., water, additives, concentrates, etc.) at a desired treatment rate to achieve a well-blended mixture (e.g., a wellbore servicing fluid, a completion fluid, or the like, such as a fracturing fluid, a cementitious fluid or cementitious slurry, a liquefied inert gas, a gel, etc.). The mixing conditions including time period, agitation method, pressure, and temperature of the blender may be chosen by one of ordinary skill in the art to produce a substantially homogenous blend of the desired composition, density, and viscosity and/or to otherwise meet the needs of the desired wellbore operation. In an embodiment, the blender 112 may comprise a tank constructed from a metal plate, composite materials, or any other material. Additionally, the blender 112 may further comprise a mixer or agitator that mixes or agitates the components of fluid within the blender 112. In an embodiment, the blender 112 may also be configured with heating or cooling devices to regulate the temperature within the blender 112. Alternatively, the fluid may be premixed and/or stored in a storage tank before entering the wellbore services manifold trailer 114.

In an embodiment, the wellbore services manifold trailer 114 may be coupled to the blender 112 via a flowline 162. As used herein, the term "wellbore services manifold trailer" includes a truck and/or trailer comprising one or more manifolds for receiving, organizing, and/or distributing wellbore servicing fluids during wellbore servicing operations. In this embodiment, the wellbore services manifold trailer 114 is coupled to six high-pressure (HP) pumps 115 via outlet flowlines 164 and inlet flowlines 166. In alternative embodiments, there may be more or fewer HP pumps used in a wellbore servicing operation. Outlet flowlines 164 are outlet lines from the wellbore services manifold trailer 114 that supply fluid to the HP pumps 115. Inlet flowlines 166 are inlet lines from the HP pumps 115 that supply fluid to the wellbore services manifold trailer 114.

In an embodiment, the HP pumps 115 are configured to pressurize a wellbore servicing fluid to a pressure suitable for delivery into the wellbore 116. For example, the HP pumps 115 may increase the pressure of the wellbore servicing fluid to a pressure of up to about 10,000, 12,000, 15,000, 18,000, or 20,000 psi or higher. The HP pumps 115 may comprise any suitable type of high-pressure pump, such as, positive displacement pumps. In an embodiment, the HP pumps 115 are configured such that the wellbore servicing fluid may reenter the wellbore services manifold trailer 114 via inlet flowlines 166 and be combined so that the wellbore servicing fluid may have a total fluid flow rate that exits from the wellbore services manifold trailer 114 through flowline 168 to the wellbore 116 of between about 1 barrel per minute (BPM) to about 200 BPM, alternatively, from between 50 BPM to about 150 BPM, alternatively, about 100 BPM.

In an embodiment the wellbore 116 may be a hole or opening in a subterranean formation and may extend substantially vertically away from the earth's surface over a vertical wellbore portion, or may deviate at any angle from the earth's surface over a deviated or horizontal wellbore portion. In alternative operating environments, portions or substantially all of the wellbore 116 may be vertical, deviated, horizontal, and/or curved.

Figure 4:
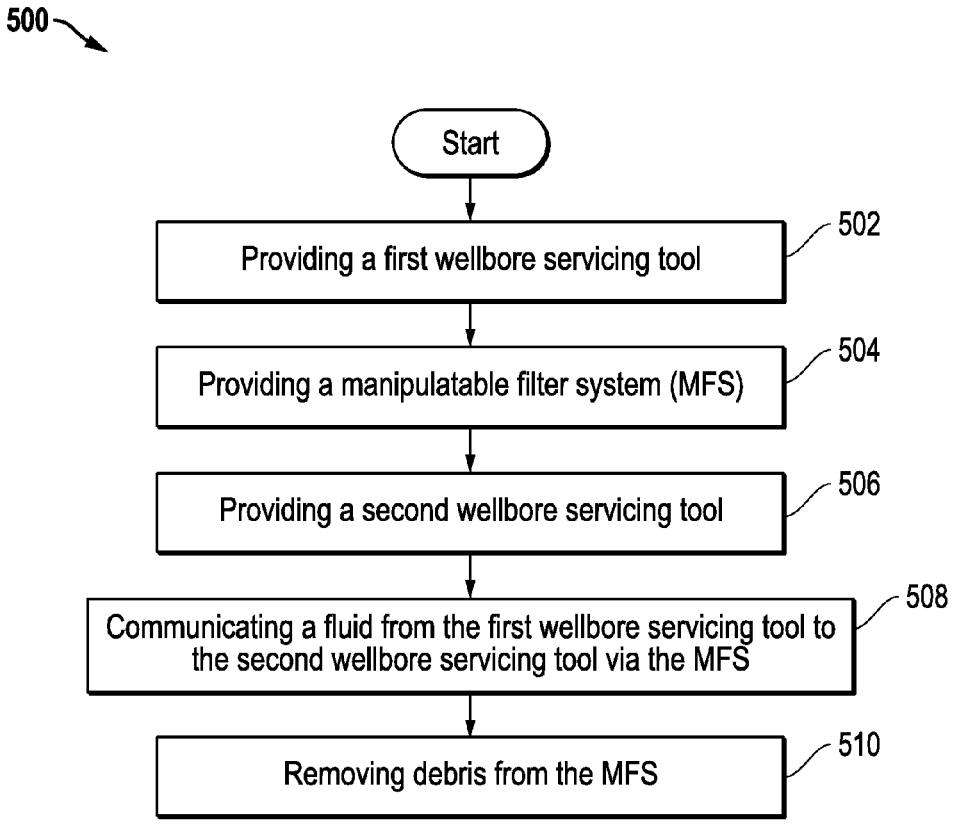
FIG. 4 is a flow chart of an embodiment of a wellbore servicing operation method.

Referring to FIG. 4, a wellbore servicing method 500 utilizing a MFS 200 and/or a system comprising a MFS 200 is disclosed herein. In an embodiment, a wellbore servicing method 500 may generally comprise the steps of providing a first wellbore servicing tool 502, providing a MFS 504, providing a second wellbore servicing tool 506, communicating a fluid from the first wellbore servicing tool to the second wellbore servicing tool via the MFS 508, and removing debris from the MFS 510.

As previously disclosed, a wellbore servicing system 100 may generally comprise a plurality of wellbore servicing tools (e.g., a trailer, a MFS, a storage tank, a blender, a wellbore services manifold trailer, a HP pump, etc.) positioned at a wellsite. For example, the wellbore servicing system 100 may be attached to a wellbore, for example, for the purpose of performing one or more wellbore servicing operations.

In an embodiment, when providing a first wellbore servicing tool 502, such a first wellbore servicing tool (e.g., the trailer 104 as shown in FIG. 1) may be transported to a well site and configured to communicate a fluid or bulk material (e.g., pneumatically) via a first flowline (e.g., via flowline 152 as shown in FIG. 1) through the wellbore servicing system 100 or a portion thereof. For example, in an embodiment, the first wellbore servicing tool (e.g., the trailer 104) may be transported to the well site (e.g., a trailer attached to a truck) and connected to the flowline 152.

Additionally, in an embodiment, when providing a second wellbore servicing tool 506, a second wellbore servicing tool (e.g., a storage tank) may be transported to the well site and configured to communicate a fluid or bulk material via a second flowline (e.g., via flowline 154 as shown in FIG. 1) through the wellbore servicing system 100. For example, in an embodiment, the second wellbore servicing tool (e.g., a storage tank) may be transported to the well site and connected to the flowline 154.

In an embodiment, providing the MFS 504 can also include one or more of the steps of designing and/or manufacturing the MFS 200 and/or a component thereof (e.g., the filter 300), assembling the MFS 200 and/or the filter 300, and installing the MFS 200 and/or the filter 300 within the wellbore servicing system.

In an embodiment, designing the filter 300 and/or the MFS 200 may generally comprise determining one or more characteristics and/or properties of the filter 300 and/or MFS 200. For example, the designing the filter 300 and/or the MFS 200 may comprise determining the number of flow paths of the MFS 200, the number of filters 300 in a flow path, the desired flow-rate through the MFS 200, the size of the holes 306 of the filter 300, etc. For example, in such an embodiment, the MFS 200 may be designed and/or configured to accommodate one or more of such characteristics, that is, a MFS 200 may be configured to provide a predetermined number of flow paths, to allow for a predetermined flow-rate there-through, to house a predetermined number of filters (e.g., in series and/or in parallel), the have one or filters having one or more predetermined sizes, or combinations thereof.

For example, in an embodiment, providing the MFS 200 may comprise the step of manufacturing the filter 300. For example, in such an embodiment, manufacturing the filter 300 may generally comprise one or more of the steps of providing a sheet of suitable material (e.g., a rigid material) having a first pair of edges and a second pair of edges (for example, which may be generally perpendicular), sizing the sheet, forming a plurality of perforations or holes into the rigid material, forming a curved profile (e.g., sinusoidal, or undulating profile, as will form the "saddle") along one or both of the edges of the first pair of edges, and curling or rolling the sheet of material such that a cylinder is formed generally parallel to the direction of the second pair of edges. Additionally, designing and/or manufacturing the filter 300 may further comprise the step of joining the second pair of edges (e.g., (e.g., welding, riveting, or otherwise fastening).

In an embodiment, where the MFS 200 comprises a plurality of discrete components, the process of assembling the MFS 200 may generally comprise one or more of the steps of providing a plurality of valves (e.g., input side isolation valves, output side isolation valves, etc.) and a plurality of fluid conduits (e.g., an input conduit, an output conduit, a plurality of flow path conduits, a plurality of filter housings, a plurality of filters, etc.) and joining the plurality of discrete components via a suitable interface (e.g., clamps, threaded connections, etc.), as previously disclosed. In such an embodiment, the MFS 200 may comprise any suitable number and/or configuration of flow paths as would be appreciated by one of ordinary skill in the art upon viewing this disclosure. For example, in an embodiment an operator may provide the plurality of discrete components of the MFS 200 to the field (e.g., a well site). In such an embodiment, the operator may assemble two or more components of the MFS 200 on-site, for example, joining an input conduit, a plurality of flow paths, a plurality of filter housings, a plurality of filters, and an output conduit via suitable interfaces (e.g., clamps, threaded connections, etc.). Additionally, in such an embodiment, the MFS 200 may be portable (e.g., carried by hand) and/or positionable by an operator (e.g., by a single operator). For example, the ability to easily assemble two or more components at the well site may allow the MFS to be handled (e.g., loaded, unloaded, positioned) by a single person.

In an embodiment, the input conduit 204 of the MFS 200 may be coupled to (e.g., put in fluid communication with) the first flowline (e.g., flowline 152 of FIG. 1) of the first wellbore serving tool (e.g., the trailer 104 of FIG. 1). In such an embodiment, the first flowline and the input conduit 204 may be coupled together and may form a fluid-tight or substantially fluid-tight connection, for example, via a threaded connection, a coupling, a clamp, a collar, a male/female coupling, a sexless coupling, a hose clamp, or any other suitable coupling mechanisms as would be appreciated by one of ordinary skill in the art upon viewing this disclosure. Additionally, the coupling between the first flowline and the input conduit 204 may further comprise one or more seals. For example, suitable seals and/or configurations of seals include, but are not limited to, an elastomeric seal, a gasket, a T-seal, an O-ring, a nylon ring, a metallic ring, etc. Further, the second flowline (e.g., flowline 154 of FIG. 1) of the second wellbore servicing tool (e.g., a dry bulk tank 106 of FIG. 1) may be coupled to and in fluid communication with the output conduit 212 of the MFS 200. In such an embodiment, the second flowline and the output conduit 212 may be coupled together and may form a fluid-tight or substantially fluid-tight connection, for example, via a threaded connection, a coupling, a clamp, a collar, a male/female coupling, a sexless coupling, a hose clamp, or any other suitable coupling mechanisms as would be appreciated by one of ordinary skill in the art upon viewing this disclosure. Additionally, the coupling between the second flowline and the output conduit 212 may further comprise one or more seals. For example, suitable seals and/or configurations of seals include, but are not limited to, an elastomeric seal, a gasket, a T-seal, an O-ring, a nylon ring, a metallic ring, etc.

In an embodiment, when communicating the fluid from the first wellbore servicing tool (e.g., the trailer 104) to the second wellbore servicing tool (e.g., the storage tank 106) via the MFS 508, a fluid or bulk material (e.g., water, gel, powdered gel, a gelling agent, cementitious fluid or cementitious slurry, etc., and/or a component thereof) may be communicated via the first flowline (e.g., flowline 152), the MFS 200, and the second flowline (e.g., flowline 154). For example, a servicing fluid or a component thereof (e.g., a gel, a powdered gel, cementitious fluid or cementitious slurry, etc. and/or a component thereof) may be communicated from the trailer 104 to the storage tank (e.g., the dry bulk tank 106) via the MFS 200.

In an embodiment, debris or trash may be present within the wellbore servicing system 100, for example, from the first wellbore servicing tool. For example, debris (e.g., packing material, environmental debris, etc.) may be introduced (e.g., inadvertently) into the first wellbore servicing tool while providing a fluid to the first wellbore servicing tool (e.g., while filling or loading the tank with water, gel, powdered gel, a gelling agent, cementitious fluid or cementitious slurry, etc.).

In an embodiment, as the fluid or bulk material is communicated through the MFS 200, debris may be removed from the fluid 510 via the operation of the MFS 200. For example, as the fluid or bulk material is communicated, the MFS 200 may be monitored for obstructions and/or restrictions, for example, caused by trash or debris (e.g., becoming lodged/trapped), within one or more of the flow paths (e.g., by the filter 300 of a given flow path) of the MFS 200. For example, the flow rate of the fluid and/or the pressure of the fluid within the flow paths may be monitored for changes tending to indicate blockage, alternatively, substantial blockage, of one or more filters 300 (e.g., a pressure spike upstream from the filter, a pressure drop across the filter, a decrease in flow-rate across the filter, a decrease in total flow-rate, etc. or combinations thereof). The MFS 200 may be examined and/or monitored at a suitable frequency, for example, substantially constantly, alternatively (e.g., substantially constantly during operation), alternatively, hourly, daily, weekly, etc., alternatively, in about real-time (e.g., while a fluid is being communicated through the MFS 200). Additionally, in an embodiment, the MFS 200 may comprise one or more alarms (e.g., an audible alarm) to indicate the occurrence of blockage across (e.g., restricting a route of fluid communication through) one or more filters.

In an embodiment, when an obstruction and/or restriction (e.g., trash, debris, etc.) is found or otherwise indicated (e.g., as a result of monitoring the MFS 200), such an obstruction or restriction may substantially restrict or prevent fluid communication via one or more flow paths of the MFS 200. In such an embodiment, the portion of the flow path having the fluid restriction (e.g., the blockage) may be fluidicly isolated from the other flow-paths through the MFS 200, for example, so as to allow the blockage to be removed while fluid continues to be communicated through one or more other flow-paths through the MFS 200. For example, the input side isolation valve 216 and the output side isolation valve 222 of the flow path having an obstruction or restriction may be closed so as to isolate or disallow fluid communication via the flow path having an obstruction or restriction, thereby isolating the obstruction or restriction (e.g., the filter having trash or debris). Additionally, fluid may continue to flow and/or be communicated through the wellbore servicing system 100 via the flow paths not having an obstruction or restriction, if present (e.g., via a second flow path, a third flow path, a fourth flow path, etc.). In an embodiment, where the MFS 200 comprises a relief valve 220, the pressure within the isolated portion of the flow paths may be relieved, for example, via actuation of the pressure relief valve 220. Additionally, in an embodiment, where the filter 300 is removable, the filter 300 and/or debris may be removed from the MFS 200, for example, via removing the housing lid 218 of the filter housing 208. Optionally, in an additional embodiment, where the MFS 200 comprises a drain plug or valve, the fluid and/or material within the isolated flow paths may be drained or relieved, for example, by opening the drain plug or so as to provide a route of fluid communication from the isolated flow path.

In an embodiment, where the filter 300 has been removed (e.g., to clear an obstruction or blockage), the filter 300 may be cleaned (e.g., to remove debris, residue, fluid, etc.). For example, the filter 300 may be wiped off, rinsed off (e.g., with a fluid, water, a solvent, etc.), blown-out (e.g., with compressed air), or the like, so as to remove the blockage. In an alternative embodiment, a second filter (e.g., a clean filter, a new filter, etc.) may be provided for installation within the MFS 200, for example, to reduce down-time of one or more flow-paths through the MFS 200 during a wellbore servicing operation.

In an embodiment, where fluid was drained from the isolated flow paths via a drain plug, the drain plug may be reinstalled following the removal of fluid from within the isolated flow path. Additionally, where the filter 300 has been removed (e.g., to clear an obstruction or blockage), the filter 300 may be reinstalled within the MFS 200. For example, reinstalling the filter 300 may include positioning and/or rotationally orienting the filter 300 to seat and/or engage with the filter housing 208, for example, disposing the filter 300 within the filter housing 208 in a first rotational orientation and/or a second rotational orientation. Further, upon installing the filter 300, the housing lid 218 may be reinstalled onto the filter housing 208. In an embodiment, upon removal of the obstruction and/or restriction from the isolated flow paths and/or the reinstallation of the filter 300, the isolated flow path may be reconfigured to allow (e.g., resume) fluid communication. For example, the input side isolation valve 216 and/or the output side isolation valve 222 may be configured to allow fluid communication via the flow path, thereby no longer isolating the flow path.

In an embodiment, the fluid or bulk material communicated through the MFS 200 may be communicated through the remainder of the wellbore servicing system, for example, for use in a wellbore servicing operation. For example, the blender 112 may receive the fluid communicated via the first wellbore servicing tool (e.g., the trailer 104), the MFS 200, and the second wellbore servicing tool (e.g., the dry bulk tank 106). Additionally, the blender 112 may also receive water (e.g., via the water tank), other fluids, and/or fluid additives (e.g., via the additives tank 110) and may blend the fluids, thereby forming a composite fluid. In an embodiment, the composite fluid is communicated from the blender 112 to the wellbore services manifold trailer 114 where it may be pressurized (e.g., via the HP pumps 115) and introduced into the wellbore 116. For example, in an embodiment, the composite fluid (e.g., a wellbore servicing fluid, such as a fracturing fluid) may be communicated through the wellbore and into the subterranean formation, for example, at a rate and/or pressure suitable for the performance of the wellbore servicing operation (e.g., at a rate and/or pressure sufficient to initiate or extend a fracture within the subterranean formation).

In an embodiment, upon the completion of the servicing operation (alternatively, upon the completion of the communication of the fluid or bulk material from the first wellbore servicing tool to the second wellbore servicing tool via the MFS 200, for example, when the trailer has been unloaded or the storage tank has been filled), an operator may disassemble the MFS 200. For example, an operator may disconnect the MFS 200 from the first wellbore servicing tool and the second wellbore servicing tool, thereby no longer providing a route of fluid communication between the first wellbore servicing tool and the second wellbore servicing tool. Additionally, in such an embodiment, the operator may disconnect the input conduit, the plurality of flow paths, the plurality of filter housings, the plurality of filters, and the output conduit from each other, for example, for transport and removal from a well site.

In an embodiment, a well tool such as the MFS 200, a wellbore servicing system such as the wellbore servicing system 100 comprising a MFS 200, a wellbore servicing method employing such a wellbore servicing system 100 and/or such a MFS 200, or combinations thereof may be advantageously employed in the performance of a wellbore servicing operation. For example, conventional well tools may be limited to a single flow path and may require frequent maintenance and/or frequently stopping of a wellbore servicing operation, for example, to remove an obstruction or a restriction (e.g., trash, debris, etc.) from the flow path. In an embodiment, a MFS like MFS 200 enables the ability to provide multiple filtered flow paths thereby allowing a fluid to continue to be communicated in the event of an obstruction or restriction within a flow path. Additionally, such a MFS provides the ability to isolate and/or to remove an obstruction or restriction from a flow path without suspending a wellbore servicing operation. Further, a MFS allows an operator to configure the MFS (e.g., number of flow paths, a filter size, a filter hole size, etc.) for a particular wellbore servicing operation. Therefore, the well tools, wellbore servicing systems, and/or wellbore servicing methods disclosed herein provide a means by which the performance and reliability may be maintained during a wellbore servicing operation.

ADDITIONAL DISCLOSURE

The following are non-limiting, specific embodiments in accordance with the present disclosure:

A first embodiment, which is a wellbore servicing system comprising a first wellbore servicing system component configured to communicate a fluid via a first fluid conduit, a second wellbore servicing system component comprising a second fluid conduit, and a filter system comprising an input conduit in fluid communication with the first fluid conduit, a plurality of input flow paths, wherein each input flow path is in fluid communication with the input conduit, a plurality of filter housings, wherein each filter housing is in fluid communication with one of the plurality of input flow paths, a filter disposed within each of the filter housings, a plurality of output flow paths, wherein each output flow path is in fluid communication with one of the filter housings, an output conduit in fluid communication with each of the output flow paths and the second fluid conduit.

A second embodiment, which is the wellbore servicing system of the first embodiment, wherein each of the input flow paths comprises an isolation valve and is selectively configurable between a first position and a second position, wherein, when in the first position, the isolation valve is configured to allow fluid communication via the input flow path, and wherein, when in the second position, the isolation valve is configured to disallow fluid communication via the input flow path.

A third embodiment, which is the wellbore servicing system of the second embodiment, wherein each of the output flow paths comprises an isolation valve and is selectively configurable between a first position and a second position, wherein, when in the first position, the isolation valve is configured to allow fluid communication via the output flow path, and wherein, when in the second position, the isolation valve is configured to disallow fluid communication via the output flow path.

A fourth embodiment, which is the wellbore servicing system of one of the first through third embodiments, wherein the filter is removable.

A fifth embodiment, which is the wellbore servicing system of the fourth embodiment, wherein each of the filters comprises a cylindrical body, a plurality of holes disposed radially about and along the cylindrical body, and a saddle profile formed radially along a terminal portion of the cylindrical body, wherein the saddle profile forms a first rotational orientation and a second rotational orientation with respect to a longitudinal axis, and wherein each of the filter housings is configured to accept the filter in the first orientation and not in the second orientation.

A sixth embodiment, which is the wellbore servicing system of one of the first through fifth embodiments, wherein the fluid is a gelling agent.

A seventh embodiment, which is the wellbore servicing system of one of the first through sixth embodiments, wherein the first wellbore servicing system component comprises a trailer.

An eighth embodiment, which is the wellbore servicing system of the seventh embodiment, wherein the trailer is configured to communicate the fluid pneumatically.

A ninth embodiment, which is the wellbore servicing system of one of the first through eighth embodiments, wherein the second wellbore servicing system component comprises a storage tank.

A tenth embodiment, which is a wellbore servicing method comprising providing a first wellbore servicing system component, providing a second wellbore servicing system component, providing a filter system comprising an input conduit; an output conduit; and a plurality of fluid flow paths between the input conduit and the output conduit, wherein, each flow path comprises a filter, connecting the filtering system to the first wellbore servicing system component via a first fluid conduit, connecting the filtering system to the second wellbore servicing system component via a second fluid conduit, and communicating a fluid from the first wellbore servicing system component to the second wellbore servicing system component via the filtering system.

An eleventh embodiment, which is the method of the tenth embodiment, further comprising monitoring the plurality of fluid flow paths for a blockage.

A twelfth embodiment, which is the method of the eleventh embodiment, further comprising removing debris from a first of the plurality of flow paths of the filtering system.

A thirteenth embodiment, which is the method of the twelfth embodiment, wherein removing debris from the first flow path comprises fluidicly isolating the filter associated with the first flow path.

A fourteenth embodiment, which is the method of the thirteenth embodiment, wherein, upon fluidicly isolating the filter associated with the first flow path, the fluid continues to be communicated via a second of the plurality of flow paths.

A fifteenth embodiment, which is the method of one of the thirteenth through fourteenth embodiments, wherein fluidicly isolating the filter associated with the first flow path comprises closing a first valve in the first flow path between the filter and the input conduit and a closing a second valve in the first flow path between the filter and the output conduit.

A sixteenth embodiment, which is the method of one of the thirteenth through fifteenth embodiments, wherein removing debris from the first flow path further comprises removing the filter from a filter housing, wherein the filter housing is incorporated within the first flow path.

A seventeenth embodiment, which is the method of the sixteenth embodiment, wherein removing the filter from the housing comprises releasing fluid pressure from the fluidicly-isolated filter.

An eighteenth embodiment, which is the method of one of the sixteenth through seventeenth embodiments, wherein removing the filter from the housing comprises draining fluid from the housing.

A nineteenth embodiment, which is the method of one of the sixteenth through eighteenth embodiments, wherein removing the filter from the housing comprises removing a cap, wherein the cap secures the filter within the housing.

A twentieth embodiment, which is the method of one of the sixteenth through nineteenth embodiments, further comprising cleaning the filter; and replacing the filter.

A twenty-first embodiment, which is the method of one of the seventeenth through twentieth embodiments, further comprising inserting a replacement filter within the housing.

A twenty-second embodiment, which is the method of one of the tenth through twenty-first embodiments, wherein the fluid comprises a gelling agent.

A twenty-third embodiment, which is the method of one of the tenth through twenty-second embodiments, wherein the fluid comprises a liquid.

A twenty-fourth embodiment, which is the method of one of the tenth through twenty-third embodiments, wherein the fluid comprises a bulk material.

A twenty-fifth embodiment, which is the method of one of the tenth through twenty-fourth embodiments, wherein providing the filtering system comprises manufacturing the filtering system.

A twenty-sixth embodiment, which is the method of one of the tenth through twenty-fifth embodiments, wherein providing the filtering system comprises manufacturing the filter.

A twenty-seventh embodiment, which is the method of the twenty-sixth embodiment, where manufacturing the filter comprises the steps of providing a sheet of a material having a first pair of edges and a second pair of edges, sizing the material, forming a plurality of holes into the material, forming a curved profile along an edge of the first pair of edges, rolling the sheet of material to form a cylinder generally parallel to the second pair of edges, and joining the second pair of edges, thereby forming the filter.

A twenty-eighth embodiment, which is the method of the fifteenth embodiment, further comprising installing the filter within a filter housing.

A twenty-ninth embodiment, which is a wellbore servicing tool comprising an input conduit in fluid communication with a first fluid conduit, a plurality of input flow paths, wherein each input flow path is in fluid communication with the input conduit, a plurality of filter housings, wherein each filter housing is in fluid communication with one of the plurality of input flow paths, a filter disposed within each of the filter housings, a plurality of output flow paths, wherein each output flow path is in fluid communication with one of the filter housings, an output conduit in fluid communication with each of the output flow paths and the second fluid conduit.

A thirtieth embodiment, which is the wellbore servicing tool of the twenty-ninth embodiment, wherein the filter comprises a cylindrical body, a plurality of holes disposed radially about and along the cylindrical body; and a saddle profile formed radially along a terminal portion of the cylindrical body, wherein the saddle profile forms a first rotational orientation and a second rotational orientation with respect to a longitudinal axis, and wherein the filter housing is configured to accept the filter in the first orientation and not in the second orientation.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore servicing system comprising:
a first wellbore servicing system component configured to communicate a fluid via a first fluid conduit;
a second wellbore servicing system component comprising a second fluid conduit, and
a filter system comprising:
an input conduit in fluid communication with the first fluid conduit;
a plurality of input flow paths, wherein each input flow path is in fluid communication with the input conduit;
a plurality of filter housings, wherein each filter housing is in fluid communication with one of the plurality of input flow paths;
a filter disposed within each of the filter housings, wherein the filter comprises:
a cylindrical body;
a plurality of holes disposed radially about and along the cylindrical body; and
a saddle profile formed radially along a terminal portion of the cylindrical body,
wherein the saddle profile forms a first rotational orientation and a second rotational orientation with respect to a longitudinal axis; and
wherein each of the filter housings is configured to accept the filter in the first orientation and not in the second orientation;
a plurality of output flow paths, wherein each output flow path is in fluid communication with one of the filter housings;
an output conduit in fluid communication with each of the output flow paths and the second fluid conduit.

2. The well bore servicing system of claim 1, wherein each of the input flow paths comprises an isolation valve and is selectively configurable between a first position and a second position,
wherein, when in the first position, the isolation valve is configured to allow fluid communication via the input flow path; and
wherein, when in the second position, the isolation valve is configured to disallow fluid communication via the input flow path.

3. The well bore servicing system of claim 2, wherein each of the output flow paths comprises an isolation valve and is selectively configurable between a first position and a second position,
wherein, when in the first position, the isolation valve is configured to allow fluid communication via the output flow path; and
wherein, when in the second position, the isolation valve is configured to disallow fluid communication via the output flow path.

4. The well bore servicing system of claim 1, wherein the filter is removable.

5. The well bore servicing system of claim 1, wherein the fluid is a gelling agent.

6. A wellbore servicing method comprising:
providing a first wellbore servicing system component;
providing a second wellbore servicing system component;
providing a filter system comprising:
an input conduit;
an output conduit; and
a plurality of fluid flow paths between the input conduit and the output conduit, wherein, each fluid flow path comprises a filter in a filter housing, the filter comprising:
a cylindrical body;
a plurality of holes disposed radially about and along the cylindrical body; and
a saddle profile formed radially along a terminal portion of the cylindrical body,
wherein the saddle profile forms a first rotational orientation and a second rotational orientation with respect to a longitudinal axis; and
wherein each of the filter housings is configured to accept the filter in the first orientation and not in the second orientation;
connecting the filtering system to the first wellbore servicing system component via a first fluid conduit;
connecting the filtering system to the second wellbore servicing system component via a second fluid conduit; and
communicating a fluid from the first wellbore servicing system component to the second wellbore servicing system component via the filtering system.

7. The method of claim 6, further comprising monitoring the plurality of fluid flow paths for a blockage.

8. The method of claim 7, further comprising removing debris from a first of the plurality of flow paths of the filtering system.

9. The method of claim 8, wherein removing debris from the first flow path comprises fluidicly isolating the filter associated with the first flow path.

10. The method of claim 9, wherein, upon fluidicly isolating the filter associated with the first flow path, the fluid continues to be communicated via a second of the plurality of flow paths.

11. The method of claim 9, wherein fluidicly isolating the filter associated with the first flow path comprises closing a first valve in the first flow path between the filter and the input conduit and closing a second valve in the first flow path between the filter and the output conduit.

12. The method of claim 11, further comprising installing the filter within the filter housing.

13. The method of claim 9, wherein removing debris from the first flow path further comprises removing the filter from the filter housing, wherein the filter housing is incorporated within the first flow path.

14. The method of claim 13, wherein removing the filter from the housing comprises releasing fluid pressure from the fluidicly-isolated filter, draining fluid from the housing, or combinations thereof.

15. The method of claim 13, wherein removing the filter from the filter housing comprises removing a cap, wherein the cap secures the filter within the filter housing.

16. The method of claim 13, further comprising:

cleaning the filter; and replacing the filter.

17. The method of claim 13, further comprising inserting a replacement filter within the filter housing.

18. The method of claim 6, wherein the fluid comprises a gelling agent, a liquid, a bulk material, or combinations thereof.

19. A wellbore servicing tool comprising:

an input conduit in fluid communication with a first fluid conduit;

a plurality of input flow paths, wherein each input flow path is in fluid communication with the input conduit;

a plurality of filter housings, wherein each filter housing is in fluid communication with one of the plurality of input flow paths;

a filter disposed within each of the filter housings, wherein the filter comprises:

a cylindrical body;

a plurality of holes disposed radially about and along the cylindrical body; and a saddle profile formed radially along a terminal portion of the cylindrical body, wherein the saddle profile forms a first rotational orientation and a second rotational orientation with respect to a longitudinal axis; and wherein the filter housing is configured to accept the filter in the first orientation and not in the second orientation;

a plurality of output flow paths, wherein each output flow path is in fluid communication with one of the filter housings;

an output conduit in fluid communication with each of the output flow paths and the second fluid conduit.

* * * * *